US008596858B2

(12) United States Patent
Ohashi et al.

(10) Patent No.: US 8,596,858 B2
(45) Date of Patent: Dec. 3, 2013

(54) APPARATUS FOR SOLID-LIQUID CONTACT

(75) Inventors: Hiroaki Ohashi, Fukushima-Ken (JP); Igari Yutaka, Fukushima-Ken (JP); Kobayashi Masanori, Fukushima-Ken (JP); Otawara Kentaro, Fukushima-Ken (JP)

(73) Assignee: Kureha Corporation, Tokyo (JP)

( * ) Notice: Subject to any disclaimer, the term of this patent is extended or adjusted under 35 U.S.C. 154(b) by 251 days.

(21) Appl. No.: 11/662,570

(22) PCT Filed: Jul. 27, 2005

(86) PCT No.: PCT/JP2005/014141

§ 371 (c)(1),
(2), (4) Date: Mar. 12, 2007

(87) PCT Pub. No.: WO2006/030588

PCT Pub. Date: Mar. 23, 2006

(65) Prior Publication Data

US 2008/0025143 A1 Jan. 31, 2008

(30) Foreign Application Priority Data

Sep. 15, 2004 (JP) ..... 2004-268602

(51) Int. Cl.
*B01F 7/20* (2006.01)

(52) U.S. Cl.
USPC ..... 366/171.1; 366/172.1; 366/307; 366/325.92; 366/181.4; 422/228

(58) Field of Classification Search
USPC ..... 366/293, 325.92, 325.93, 65–66, 171.1, 366/172.1, 172.2, 307, 325.94, 181.4; 422/228
See application file for complete search history.

(56) References Cited

U.S. PATENT DOCUMENTS 1,993,446 A * 3/1935 Huff ..... 208/298
2,029,688 A * 2/1936 Wilson ..... 366/171.1
2,029,690 A * 2/1936 Wilson ..... 208/339

(Continued)

FOREIGN PATENT DOCUMENTS

EP 0 011 870 6/1980
EP 1508364 A1 * 2/2005 ..... B01F 11/00

(Continued)

OTHER PUBLICATIONS

Supplementary European Search Report issued Jul. 4, 2011 in corresponding European Application No. EP 05 76 8838.

*Primary Examiner* — Charles E Cooley
(74) *Attorney, Agent, or Firm* — Wenderoth, Lind & Ponack, L.L.P.

(57) ABSTRACT

A vertical solid-liquid contact apparatus including a plurality of stirring chambers disposed vertically adjacent to each other in series, a plurality of partitioning plates each partitioning an adjacent pair of the stirring chambers and provided with a communicating hole for communication between the adjacent pair of the stirring chambers, and a liquid inlet and a solid inlet provided at an upper part and a lower part of the apparatus. Each stirring chamber having an inner side wall defining the stirring chamber, a radially ejecting stirring blade, and at least one baffle fixed on the inner side wall. The stirring blade and the baffle are positionally biased to a lower side of the stirring chamber. The apparatus provides a good uniformity of solid-liquid flows and a high contact efficiency, is also simple in structure and allows easy scale-up.

8 Claims, 4 Drawing Sheets

(56) References Cited

U.S. PATENT DOCUMENTS

| | | | | | |
|---|---|---|---|---|---|
| 2,029,691 | A | * | 2/1936 | Robinson | 196/14.52 |
| 2,539,732 | A | * | 1/1951 | Donohue | 210/522 |
| 2,582,899 | A | * | 1/1952 | Barnebey et al. | 422/193 |
| 2,667,407 | A | * | 1/1954 | Fenske et al. | 423/658.5 |
| 2,804,379 | A | * | 8/1957 | Olney et al. | 422/228 |
| 2,893,846 | A | * | 7/1959 | Wistrich et al. | 422/228 |
| 2,908,652 | A | * | 10/1959 | Forrester | 95/242 |
| 2,914,385 | A | * | 11/1959 | Massey et al. | 422/259 |
| 3,010,803 | A | * | 11/1961 | Olney et al. | 422/228 |
| 3,010,804 | A | * | 11/1961 | Olney et al. | 422/228 |
| 3,013,866 | A | * | 12/1961 | Samaniego et al. | 422/228 |
| 3,143,395 | A | * | 8/1964 | Milmore | 366/290 |
| 3,150,934 | A | * | 9/1964 | Hazard | 422/259 |
| 3,156,534 | A | * | 11/1964 | Josephson et al. | 422/159 |
| 3,194,638 | A | * | 7/1965 | Neuville | 422/162 |
| 3,222,141 | A | * | 12/1965 | Donaldson | 422/228 |
| 3,233,876 | A | * | 2/1966 | Faure et al. | 366/171.1 |
| 3,266,872 | A | * | 8/1966 | Hinago et al. | 422/205 |
| 3,318,668 | A | * | 5/1967 | Ziehl | 422/259 |
| 3,321,283 | A | * | 5/1967 | Ewald | 422/225 |
| 3,408,051 | A | * | 10/1968 | McWhirter | 366/177.1 |
| 3,494,412 | A | * | 2/1970 | Abraham | 164/155.5 |
| 3,709,664 | A | * | 1/1973 | Krekeler et al. | 422/225 |
| 3,801,370 | A | * | 4/1974 | Porter et al. | 134/25.1 |
| 3,822,999 | A | * | 7/1974 | Pope | 422/228 |
| 3,855,368 | A | * | 12/1974 | Prochazka et al. | 261/81 |
| 3,871,445 | A | * | 3/1975 | Wanka et al. | 165/104.14 |
| 3,950,138 | A | * | 4/1976 | Wolf et al. | 422/135 |
| 3,973,759 | A | * | 8/1976 | Mizrahi et al. | 366/264 |
| 4,042,217 | A | * | 8/1977 | Snider et al. | 366/177.1 |
| 4,076,681 | A | * | 2/1978 | Boehme et al. | 523/324 |
| 4,212,848 | A | | 7/1980 | Boehme et al. | |
| 4,400,219 | A | * | 8/1983 | Vanderputten et al. | 127/23 |
| 4,483,624 | A | * | 11/1984 | Bacon et al. | 366/293 |
| 4,610,547 | A | * | 9/1986 | Bennett et al. | 366/270 |
| 4,792,238 | A | * | 12/1988 | Yoneyama et al. | 366/307 |
| 5,078,505 | A | * | 1/1992 | Nyman et al. | 366/262 |
| 5,098,669 | A | * | 3/1992 | Kawanami et al. | 422/135 |
| 5,145,556 | A | * | 9/1992 | Westerberg et al. | 162/29 |
| 5,160,041 | A | * | 11/1992 | Taniguchi et al. | 210/205 |
| 5,240,327 | A | * | 8/1993 | Nyman et al. | 366/302 |
| 5,248,485 | A | * | 9/1993 | Lilja et al. | 422/229 |
| 5,294,408 | A | * | 3/1994 | Muzik et al. | 422/162 |
| 5,391,000 | A | * | 2/1995 | Taniguchi | 366/332 |
| 5,762,417 | A | * | 6/1998 | Essen et al. | 366/264 |
| 5,795,732 | A | * | 8/1998 | Schilling et al. | 435/41 |
| 6,024,481 | A | * | 2/2000 | Hillstrom et al. | 366/155.1 |
| 6,132,080 | A | * | 10/2000 | Gurth | 366/286 |
| 6,866,831 | B2 | * | 3/2005 | Nakao et al. | 422/205 |
| 6,988,823 | B2 | * | 1/2006 | Wilson | 366/163.2 |
| 7,090,391 | B2 | * | 8/2006 | Taniguchi | 366/118 |
| 7,350,961 | B2 | * | 4/2008 | Taniguchi | 366/118 |
| 8,119,084 | B2 | * | 2/2012 | Strauss et al. | 422/630 |
| 2004/0057332 | A1 | * | 3/2004 | Taniguchi | 366/118 |
| 2004/0136262 | A1 | * | 7/2004 | Wilson | 366/163.2 |
| 2005/0094486 | A1 | * | 5/2005 | Taniguchi | 366/171.1 |
| 2006/0120212 | A1 | * | 6/2006 | Taniguchi et al. | 366/118 |
| 2006/0231473 | A1 | * | 10/2006 | Taniguchi | 210/219 |
| 2008/0025143 | A1 | * | 1/2008 | Ohashi et al. | 366/181.4 |
| 2008/0282606 | A1 | * | 11/2008 | Plaza et al. | 44/308 |
| 2013/0068256 | A1 | * | 3/2013 | Kobayashi et al. | 134/18 |

FOREIGN PATENT DOCUMENTS

| | | | | | |
|---|---|---|---|---|---|
| JP | 49-41029 | | | 4/1974 | |
| JP | 54060275 | A | * | 5/1979 | |
| JP | 55-88841 | | | 7/1980 | |
| JP | 03143537 | A | * | 6/1991 | B01F 7/00 |
| JP | 10168016 | A | * | 6/1998 | C07C 43/11 |
| JP | 10328547 | A | * | 12/1998 | B01F 11/00 |
| JP | 11-34951 | | | 12/1999 | |
| JP | 2001239140 | A | * | 9/2001 | B01F 11/00 |
| JP | 2003001083 | A | * | 1/2003 | B01F 11/00 |
| JP | 2003047833 | A | * | 2/2003 | B01F 11/00 |
| JP | 2005058916 | A | * | 3/2005 | B01F 11/00 |
| JP | 2005103340 | A | * | 4/2005 | B01F 11/00 |
| WO | 02/092206 | | | 11/2002 | |

* cited by examiner

APPARATUS FOR SOLID-LIQUID CONTACT

TECHNICAL FIELD

The present invention relates to a solid-liquid contact apparatus for contacting a solid and a liquid to effect an operation, such as washing, purification, extraction, impregnation or dissolution, practiced principally in the field of chemical industry; particularly a continuous multi-stage stirring-type solid-liquid contact apparatus exhibiting a high solid-liquid contact efficiency and a solid-liquid contact method using the apparatus.

BACKGROUND ART

Hitherto, a countercurrent continuous contact scheme showing a high contact efficiency has been recognized to be advantageous as a method for solid-liquid contact treatment, i.e., a contact treatment between a solid or solid particles in a slurry and a treatment liquid. In order to effect a uniform and high-efficiency treatment with a small amount of solid-liquid contact, it is desirable to remove a dead zone or a short path for respective streams and improve the solid-liquid mixing so as to promote the renewal of solid-liquid boundary. On the other hand, however, a better mixing is liable to be accompanied with back mixing in the direction of solid and liquid flow axes which remarkably deteriorate the contact efficiency, so that it is difficult to attain a good compatibility there between. In order to reduce the back mixing while maintaining a good solid-liquid mixing state, there has been known a method of partitioning a flow path in a chamber with partitioning plates into a plurality of chambers forming multiple stages, but this cannot provide a good contact efficiency as expected since back mixing is also caused by countercurrent flows between the respective chambers. It is also effective for reducing the back mixing to reduce the sectional area of the flow path between the respective chambers, but this is accompanied with a reduction of treatment capacity and is therefore not practical.

In order to improve the above-mentioned problem, there has been widely and generally known a mixer-settler-type extraction apparatus which includes in separation a mixer section for effecting a sufficient contact and a settler section for uniformly maintaining the respective countercurrent flows, but this requires a large size of apparatus since the functionally-separated respective sections have to retain necessary volumes. Many proposals have been introduced for reducing the apparatus volume, e.g., by adopting vertically arranged multiple stages as disclosed in Patent document 1 listed below. However, according to this type of apparatus, the flows in the settler section are liable to cause a non-uniform portion, and as a result, it becomes difficult to uniformize the treatment on the solid side, so that this type of apparatus is unsuitable as apparatus for operations, particularly for providing an objective product on the solid side, such as washing and impregnation.

In addition to the above, for solid-liquid extraction operation, there has been generally adopted a type of apparatus including a conveyer, such as a belt, baskets or a screw for forming a solid moving layer, and moving a liquid as a counter-current flow on a crossing stream respectively penetrating through the solid moving layer, but a uniform treatment on the solid side is difficult thereby, leaving a problem as an apparatus particularly for operations, such as washing and impregnation, for providing a solid objective product.

As a means for preventing a dead zone and a short path in an apparatus, Patent document 2 listed below discloses to provide a vertically movable stirring blade in each of multi-stage vessels, but on the other hand, no particular attention has been paid for reducing the back mixing.

Further, Patent documents 3 to 5 listed below disclose multi-stage stirring chamber-type apparatus wherein inter-chamber openings are formed between annular partitioning plates and a stirring shaft equipped with stirring blades or disks or between annular partitioning plates and rotating disks affixed to a stirring shaft, and the openings are caused to have a certain thickness in the shaft direction so as to prevent the back mixing in the axial direction. However, all of these apparatus have adopted a form of obstructing inter-vessel streams, so that they may be categorized as apparatus for preventing the back mixing at the cost of a treatment capacity.

As described above, few studies have been made so far for providing a solid-liquid contact apparatus allowing a commercial scale use which allows a good solid-liquid mixing so as to effect a uniform and high-efficiency solid-liquid contact, while reducing the back mixing to prevent a lowering in treatment capacity.

Patent document 1: JP-B 54-12265,
Patent document 2: JP-B 36-13059,
Patent document 3: JP-B 49-41029,
Patent document 4: JP-B 50-8713,
Patent document 5: JP-B 51-18903,

DISCLOSURE OF INVENTION

A principal object of the present invention is to provide a continuous multi-stage stirring chamber-type solid-liquid contact apparatus exhibiting a high contact efficiency.

Another object of the present invention is to provide a solid-liquid contact apparatus which allows a high uniformity of solid and liquid flows and has a simple structure allowing an easy scale-up.

Still another object of the present invention is to provide an efficient solid-liquid contact method using the above-mentioned solid-liquid contact apparatus.

The vertical solid-liquid contact apparatus of the present invention has been developed for accomplishing the above objects and comprises: a plurality of stirring chambers disposed vertically adjacent to each other in series, a plurality of partitioning plates each partitioning an adjacent pair of the stirring chambers and provided with a communicating hole for communication between the adjacent pair of the stirring chambers, and a liquid inlet and a solid inlet provided at an upper part and a lower part of the apparatus; each stirring chamber having an inner side wall defining the stirring chamber, a radially ejecting stirring blade, and at least one baffle fixed on the inner side wall so as to extend vertically, the stirring blade and the baffle being positionally biased to a lower side of the stirring chamber.

The present invention is also capable of continuously introducing a liquid into the lower part of the solid-liquid contact apparatus, and is below the plurality of partitioning plates, for continuously introducing a solid into the upper part of the solid-liquid contact apparatus, and is above the plurality of partitioning plates. A solid outlet is provided at a lower part of the solid-liquid contact apparatus for continuously discharging a solid out of the lower part of the solid-liquid contact apparatus, and is below the plurality of partitioning plates. Moreover, the diameter of each radially ejecting stirring blade is larger than the diameter of each communicating hole.

In the solid-liquid contact apparatus of the present invention, each stirring chamber is constructed vertically asymmetrically, and each stirring chamber is provided with a lower stirring region functioning to improve the solid-liquid contact efficiency and an upper rectification region, thereby having succeeded in improving the solid-liquid contact efficiency while preventing the back mixing of axial flows.

It is also noted that the present invention can be configured such that an entirety of each radially ejecting stirring blade and each baffle is disposed in a respective stirring chamber.

Further, the solid-liquid contact method of the present invention is characterized by performing solid-liquid contact in the above-mentioned solid-liquid contact apparatus, while stirring a solid-liquid mixture at a Reynolds number in a range of 500 to 500,000 and supplying a solid flow at a load ratio of at least 60% with respect to a maximum load of the apparatus. The method is based on an experimental result that the solid-liquid contact efficiency is improved as the load ratio is increased (as shown in Examples described hereinafter).

BEST MODE FOR PRACTICING THE INVENTION

Figure 1:
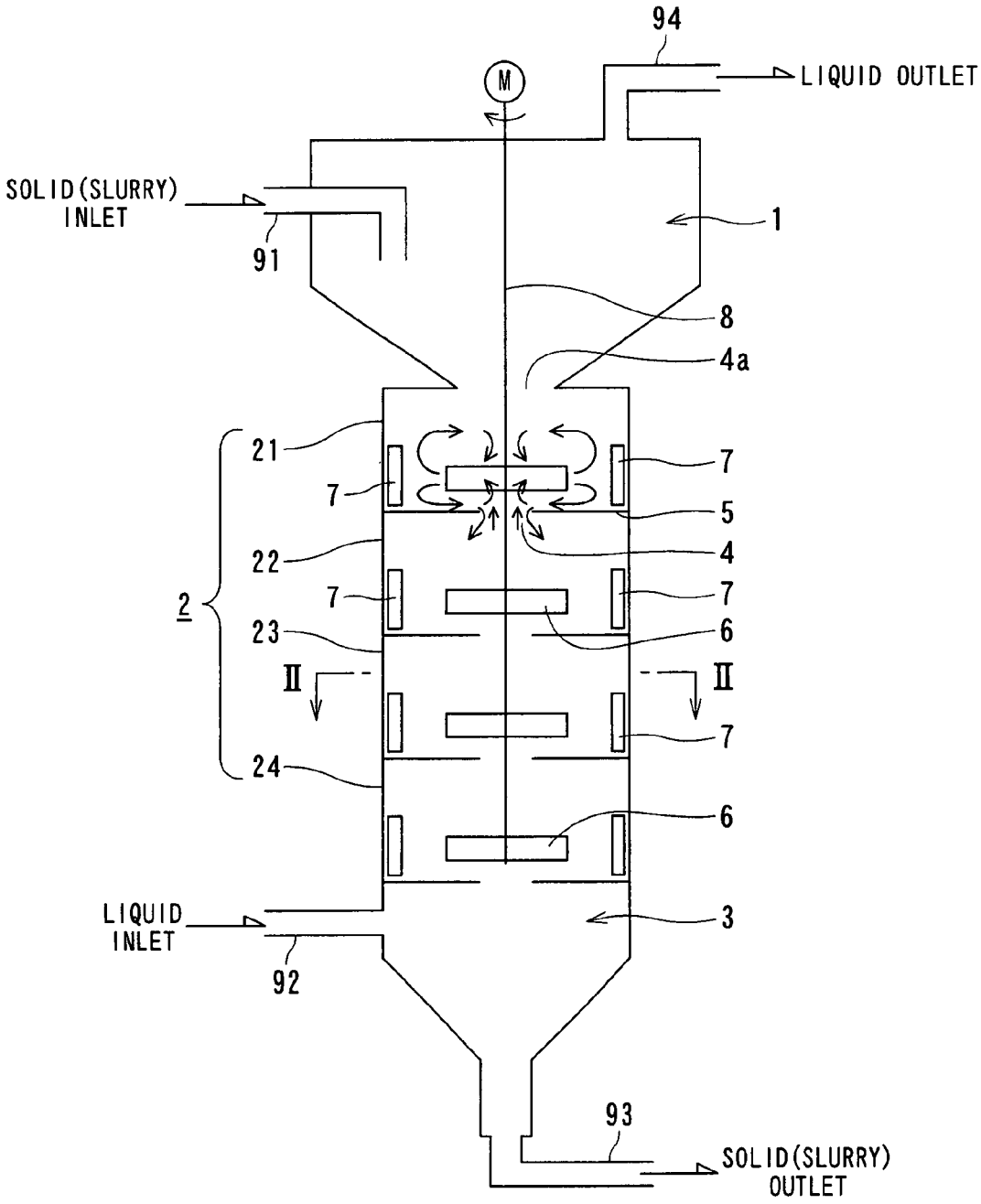
FIG. 1 is a schematic vertical sectional view of an embodiment of the vertical solid-liquid contact apparatus of the invention.
Figure 2:
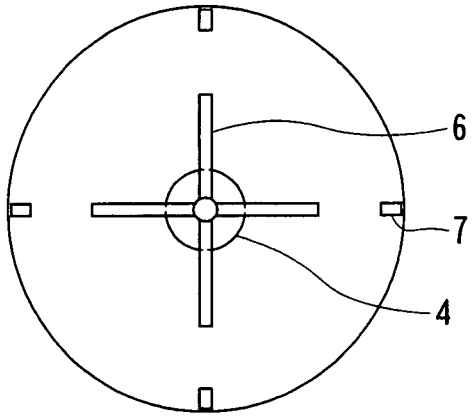
FIG. 2 is a sectional view as viewed in the direction of arrows II-II in FIG. 1.

FIG. 1 is a schematic vertical sectional view of vertical (or columnar) countercurrent solid-liquid contact apparatus according to an embodiment of the present invention, and FIG. 2 is a sectional view as viewed in the direction of arrows II-II in FIG. 1. This embodiment is designed for solid-liquid contact between solid particles having a relatively large density (or a slurry containing such solid particles) and a liquid having a relatively small density as in an ordinary solid-liquid system.

Referring to FIG. 1, the apparatus generally comprises a top section 1, a main body (section) 2 and a bottom section 3. The main body section 2 is divided into a plurality of stirring chambers, i.e., four stirring chambers 21-24, and each adjacent pair of stirring chamber are divided by a partitioning plate 5 having an opening (communicating hole) 4 at its center. Each of the stirring chambers 21-24 is provided with a flat paddle stirring blade 6 and baffles 7 in a form of being localized in a lower side of each stirring chamber, preferably in a form of being disposed in a lower half of each stirring chamber. The flat paddle stirring blade 6 disposed, as an example of radially ejecting stirring blade, in each stirring chamber 21-24, is rotatably affixed onto a common stirring shaft 8 extending through the top section 1 and the main body section 2, and the baffles 7 (provided in a number of 4 disposed at radially equi-distant positions in this embodiment) are affixed onto the inner wall of the stirring chamber so as to extend vertically.

The top section 1 is equipped with a solid (slurry) inlet pipe 91 and a liquid outlet pipe 94, and the bottom section 3 is provided with a liquid inlet pipe 92 and a solid (slurry) outlet pipe 93. The top section 1 may be provided with a flow sectional area which is enlarged at a ratio of ca. 1 to 4 times with respect to that in the main body section 2 so that a solid (slurry) stream introduced through the pipe 91 is not readily affected by axially back mixing with a liquid stream discharged through the pipe 94.

In the apparatus thus organized, a solid (slurry) stream introduced into the top section 1 through the pipe 91 is introduced into the first stirring chamber 21 without being affected by substantial back mixing and sucked by a flat paddle stirring blade 6 localized in a lower region in the stirring chamber 21 to be ejected radially and split into an ascending flow at positions above the blade-affixed position and a descending flow at positions below the blade-affixed position owing to a function of the baffles localized also in a lower region of the stirring chamber and affixed to the inner wall thereof. More specifically, as a result of localizing the blade 6 and the baffles 7 in a lower region, a stream sucked by the stirring blade and principally comprising the solid (slurry) forms a small circulating flow below the blade, a relatively large circulating flow just above the blade and also a gentle flow having a (slightly) lower concentration of the solid particles at a ceiling section of the stirring chamber 21, as represented by arrows in the figure. As a result, there arise a descending flow having a larger concentration of solid particles in proximity to an outer periphery of the center opening 4 of the partitioning plate 5 and also an ascending flow rich in the liquid introduced from the liquid inlet 92 at a central part of the opening 4 around the stirring shaft 8, and the ascending flow is sucked by, the blade 6 to be subjected to mixing under stirring with the solid (slurry) introduced from above the blade. Owing to a series of such hydraulic actions, the solid-liquid contact of the solid (slurry) introduced from the pipe 91 and the liquid introduced from the pipe 92 is effectively accomplished while suppressing the axial back mixing.

Then, the stream rich in solid particles introduced from the stirring chamber 21 to the stirring chamber 22 is, similarly as in the stirring chamber 21, subjected to an effective solid-liquid contact treatment with the liquid introduced from the pipe 92 under the radially ejecting stirring action and rectifying action of the flat paddle blade 6 and baffles 7 disposed in a lower region of the stirring chamber 22, without being substantially affected by back mixing in a ceiling region (so-called rectifying region) with a relatively gentle flow in the stirring chamber 22.

Further, similar solid-liquid contact treatments are repeated also in the stirring chambers 23 and 24, and as a result of repetition of such effective solid-liquid contact treatment in the state of suppressing the axial back mixing, it is believed possible to accomplish an overall high solid-liquid contact efficiency.

In the main body section 2 including the stirring chambers 21-24, the solid particles in the solid (slurry) introduced from the pipe 91 have a higher density than the liquid introduced from the pipe 92, and the solid particles are driven and moved downward due to sedimentation under the action of a relatively large gravity and formation of a descending stream under the action of a relatively large dynamic pressure exerted by the stirring blade 6. These actions and the suppression of back mixing are believed to be the reason why a high treatment efficiency per volume can be attained in the apparatus of the present invention.

As a solid-liquid density difference is utilized in the apparatus of the present invention, it is necessary that a density difference is present between the solid and the liquid. In this regard, the solid-liquid density ratio, i.e., (apparent density of solid)/(density of liquid) or (density of liquid)/(apparent density of solid), should be in the range of 1.03-20, preferably 1.05-10, further preferably 1.10-5. In case where the solid-liquid density ratio is below 1.03, the solid-liquid separation is liable to be inferior, and if the solid-liquid density ratio is above 20, the solid-liquid contact efficiency is liable to be lowered.

The solid (slurry) subjected to solid-liquid contact in the main body section 2 is caused to contact the liquid introduced from the pipe 92 without being affected by substantial back mixing in the bottom section 3 to be discharged as a solid (slurry) from a bottom pipe 93.

On the other hand, the liquid introduced from the pipe 92 is subjected to gentle solid-liquid contact in the bottom section 3, solid-liquid contact accompanied with stirring in the main body section 2 and gentle solid-liquid contact in the top section 1, respectively with the solid (slurry) introduced from the pipe 91, and then discharged out of an upper pipe 94 at the top section.

Incidentally, the above-described state or presence of the relatively small circulating flow below the blades 6, the relatively large circulating flow above the blades 6, the descending flow at the outer periphery of the openings 4 and the ascending flow at the center of the openings 4 in the respective stirring chambers 21-24, has been confirmed as a result of observation of the fluid from outside of the main body 2 formed of a transparent material.

The apparatus of FIG. 1 can be applied to any type of unit operation wherein a solid (slurry) introduced from the pipe 91 and a liquid introduced from the pipe 92 are subjected to solid-liquid contact in the apparatus, and specific examples thereof may include: washing, purification, extraction, impregnation, reaction and dissolution.

In order to operate the solid-liquid contact apparatus of the present invention at a good solid-liquid contact efficiency, it is desirable to provide the solid-liquid mixture in each stirring chamber with an appropriate mixing state, and it has been experimentally confirmed that this is satisfied by a stirring Reynolds number (Re) in the range of 500-500,000, more preferably 800-100,000, particularly preferably 1,200-30,000. More specifically, this is based on experimental results that the solid-liquid contact efficiency in each stirring chamber (stage efficiency) is generally increased along with an increase of Re, but if Re is increased in excess of certain value, the stage efficiency is rather lowered due to increased back mixing between the adjacent stirring chambers.

The stirring Reynolds number is determined by the following equation (1) as described in, e.g., "Kagaku Kogaku Binran (Chemical Engineer's Handbook) (6th. Ed.)" Edited by The Society of Chemical Engineers, Japan (Published from Maruzen K.K. (1999))

$$Re=\rho n d^2/\mu \quad (1),$$

wherein ρ: average density of a slurry liquid in a stirring chamber [kg/m$^3$], n: stirring rotation speed [1/s], d: stirring blade diameter [m], and μ: viscosity of the slurry liquid in the stirring chamber [Pa·s]. Re can be calculated by using physical properties, such as ρ and μ, e.g., obtained by direct measurement or described in literature such as "Kagaku Binran (Chemical Handbook) (4th. Ed)" Edited by Chemical Society of Japan (published from Maruzen K.K.), and an example of the calculation is given in Example 1 described hereinafter.

Further, it has been confirmed that the solid-liquid contact apparatus of the present invention as represented by FIG. 1 exhibits a good solid-liquid contact efficiency when operated in the neighborhood of its maximum load. In an ordinary apparatus, as the load thereto is increased, the residence time is decreased and back mixing flow is increased, so that the efficiency of the apparatus is lowered. However, in the case of the apparatus of the present invention, it is considered that the increase of back mixing flow accompanying the increase of load is extremely small, and the efficiency of the apparatus is rather increased as the load is increased by exceeding the negative effect caused by the decrease in the residence time.

More specifically, when the maximum allowable treatment flow capacity of the apparatus is taken as a maximum load of the apparatus, it is preferred to operate the apparatus at a treatment flow capacity which is at least 60%, more preferably at least 80%, further preferably at least 90%, of the maximum load. Herein, the maximum load, i.e., the maximum value of treatment flow capacity, may be determined experimentally in the following manner.

(Maximum Value of Treatment Flow Capacity)

(a) In the case where substantially all the amount of the solid flow supplied from the pipe 91 is discharged out of the pipe 93 (For example, in the operation of washing, purification, extraction or impregnation of a solid with a liquid).

First, the ratio of solid and liquid treated in the apparatus of FIG. 1 is determined as a solid-liquid ratio. Then, while the stirring blades 6 are rotated at a speed so as to satisfy: $1200 \leq Re \leq 30000$, the solid and liquid are started to be supplied to pipe 91 and the pipe 92 so as to provide the predetermined solid-liquid ratio, and the flow (supply) rates are gradually increased while keeping the predetermined solid-liquid ratio. When the solid flow rate supplied from the pipe 91 exceeds the solid flow rate discharged out of the pipe 93, the solid flow supply rate and the liquid supply rate are assumed to be maxima of the respective flow supply rates, and the total value thereof is taken as the maximum treatment flow capacity.

(b) In the case where the amount of solid supplied from the pipe 91 is gradually decreased as the solid is moved through the apparatus (For example, in dissolution of a solid).

First, a target value of concentration of dissolved solid (C(g/ml) at the liquid outlet 94 and a target value of dissolution percentage (S(%) are set for the apparatus of FIG. 1. Further, a ratio (Fs/Fl) between the solid flow supply rate (Fs) and the liquid flow supply rate (Fl) is determined so as to provide the target value of concentration (C) when all the supplied solid is dissolved. While keeping the ratio, the solid flow supply rate (Fs) and the liquid flow supply rate (Fl) are gradually increased. Initially, all the amount of supplied solid is dissolved, but when the solid supply rate exceeds the dissolution speed of the solid, a solid is discharged out of the pipe 93. At this point of time, the solid in the apparatus is distributed in a larger amount in the stirring chamber 21 at an upper part of the apparatus and in a smaller amount in the stirring chamber 24 at a lower part in the apparatus. Then if only the solid supply rate is increased while retaining the liquid supply rate, the distribution of the solid in the stirring chamber 24 at a lower part of the apparatus is increased so that the solid-liquid contact area in the whole apparatus is increased and the concentration of the dissolved solid at the liquid outlet is increased. Thus, the dissolved solid concentration at the liquid outlet can be increased by increase the ratio (Fs/Fl) of the solid supply rate (Fs) and the liquid supply rate (Fl), whereas the rate of discharged solid is gradually increased. Accordingly, the solid supply rate is increased so as to increase the ratio (Fs/Fl) while increasing the liquid supply rate until a point of time when either one of the target concentration value (C) at the liquid outlet and the target percentage of dissolved solid (S) cannot be stably retained. The solid supply rate at that time is assumed to be the maximum value, and the solid discharge rate at that time is assumed to be the upper limit.

The above operation (b) can also be applied to a case where the supplied solid and supplied liquid are reacted with each other, and a part or all of the solid is gradually decreased by the reaction and discharged out of the liquid outlet.

The maximum load and the solid-liquid contact efficiency of the apparatus of FIG. 1 determined principally based on the solid flow supply rate depend principally on the sizes of the respective stirring chambers 21-24 and the opening (or aperture) ratio of the partitioning plates 5 between the stirring chambers.

According to our knowledge, it is preferred to set a ratio (H/D) between the height (H) and the inner diameter (D) of each of the stirring chambers 21-24 within a range of 0.1-3.0, particularly 0.25-1.5, and provide the communication hole or opening 4 with an opening area (a total area in case where a plurality of holes 4 are provided) which is 0.2 to 20%, particularly 1-10%, of the sectional area of the stirring chamber at a position or height level of the partitioning plate 5, whereby a good efficiency of solid-liquid contact becomes possible while suppressing the back mixing in the stirring chamber. In the case of operation in a system having a large solid-liquid density ratio, it is possible to use a relatively small ratio of H/D to reduce the entire apparatus height. On the other hand, in the case of operation in a system having a small solid-liquid density ratio, it is desirable to increase the H/D ratio, thereby promoting the formation of a rectifying region in an upper side of the stirring chamber.

Whether the solid (slurry) supplied from the pipe 91 should be solid particles alone or a slurry thereof depends on the species of the solid and liquid and the easiness of supplying the solid particles alone. Generally, if the purpose of the solid-liquid contact allows, the slurry form allows an easier supply to the apparatus. In this case, the solid/liquid ratio for providing the slurry is determined principally from the viewpoint of easiness of the slurry supply, and it is generally preferred to use a higher solid/liquid ratio (i.e., using a smaller amount of liquid for the slurry formation). Further, it is preferred that the liquid in the slurry is separated from the solid particles as quickly as possible (and without being mixed with the liquid introduced from the pipe 92) to be discharged out of the pipe 94. Also for this reason, it is preferred that the top section 1 is provided with a larger sectional area than the main body section 2 so as to provide a state close to a laminar flow state.

The viscosity of the liquid in the stirring chamber for operation in the apparatus of the present invention may preferably be $0.01\times10^{-3}$-1.0 Pa·s, preferably $0.05\times10^{-3}$-0.5 Pa·s, further preferably $0.1\times10^{-3}$-0.1 Pa·s in the case of using a stirring blade, such as a flat paddle blade or a disk turbine blade. In a high viscosity region in excess of 1 Pa·s or in a low viscosity region below $0.01\times10^{-3}$ Pa·s, the stirring and mixing state in the stirring region at a lower part in the chamber becomes worse, thus resulting in a lower solid-liquid contact efficiency.

The liquid for the slurrying introduced from the pipe 91 and the liquid introduced from the pipe 92 may preferably be identical in many cases, but can be different from each other depending on the purpose of the solid-liquid contact. The different liquids can be immiscible with each other but may preferably be miscible with each other from the viewpoint of rectification of flows between adjacent stirring chambers.

Whether the discharge stream out of the pipe 93 should comprise the solid particles alone or a slurry thereof may also depend on the species of the solid and liquid and the adaptability to a subsequent step. A slurry form having a good flowability is desired in many cases, and also in such cases, it is preferred for the liquid in the slurry that the liquid introduced into the bottom section 3 from the pipe 92 is guided to the pipe 93 without being excessively mixed therein and discharged as the slurry together with the solid particles. In other words, in the bottom section 3, it is preferred to form a laminar flow state wherein principally the solid particles alone flow downwards as a flow in a reverse direction with respect to a major flow of the liquid.

The solid-liquid contact apparatus of the present invention as represented by the one shown in FIG. 1 has an advantage of easy scale-up in addition to the advantage of a large treatment capacity per volume.

As methods for scaling-up of stirring operation so as to retain a flow state attained in a small-scale stirring vessel, there are known a method of using a constant speed of stirring blade tip or a constant stirring power per unit volume as a basis, and also a method of using a constant Reynolds number for stirring as a basis. Further, it is also known that a particle drifting limit stirring speed in a stirring operation for a solid-liquid system can be maintained by using a rotation speed giving a constant stirring power per unit volume, if similarities are satisfied in shapes of the stirring vessels and the inner members such as stirring blades and baffles, and systems of similar solid-liquid states are treated.

According to these methods, however, for a scale-up of a solid-liquid contact apparatus of a multi-stage stirring vessel (or chamber) type, it is difficult to predict a back mixing between vessels (or chambers) so that it has been difficult to accurately obtain a designed contact efficiency. In the present invention, not only Re is controlled at constant (or in a constant range) but also it has become possible to suppress reverse mixing flows between the chambers by an appropriate combination of "positional setting of a stirring blade and a baffle in a stirring chamber" and "setting of Re in a prescribed range". As a result, it has become possible to use a contact efficiency obtained in a small-scale experiment at a good reproducibility in scaling-up, thus affording an increased accuracy of designing.

(Comparative Apparatus)

The above-mentioned essential effects of the apparatus of the present invention cannot be attained by a conventional continuous multi-stage stirring-type solid-liquid contact apparatus wherein in each stirring chamber, the stirring blade is disposed at an almost central position and the baffles are disposed so as to extend over an almost entire range of the stirring chamber height.

Figure 3:
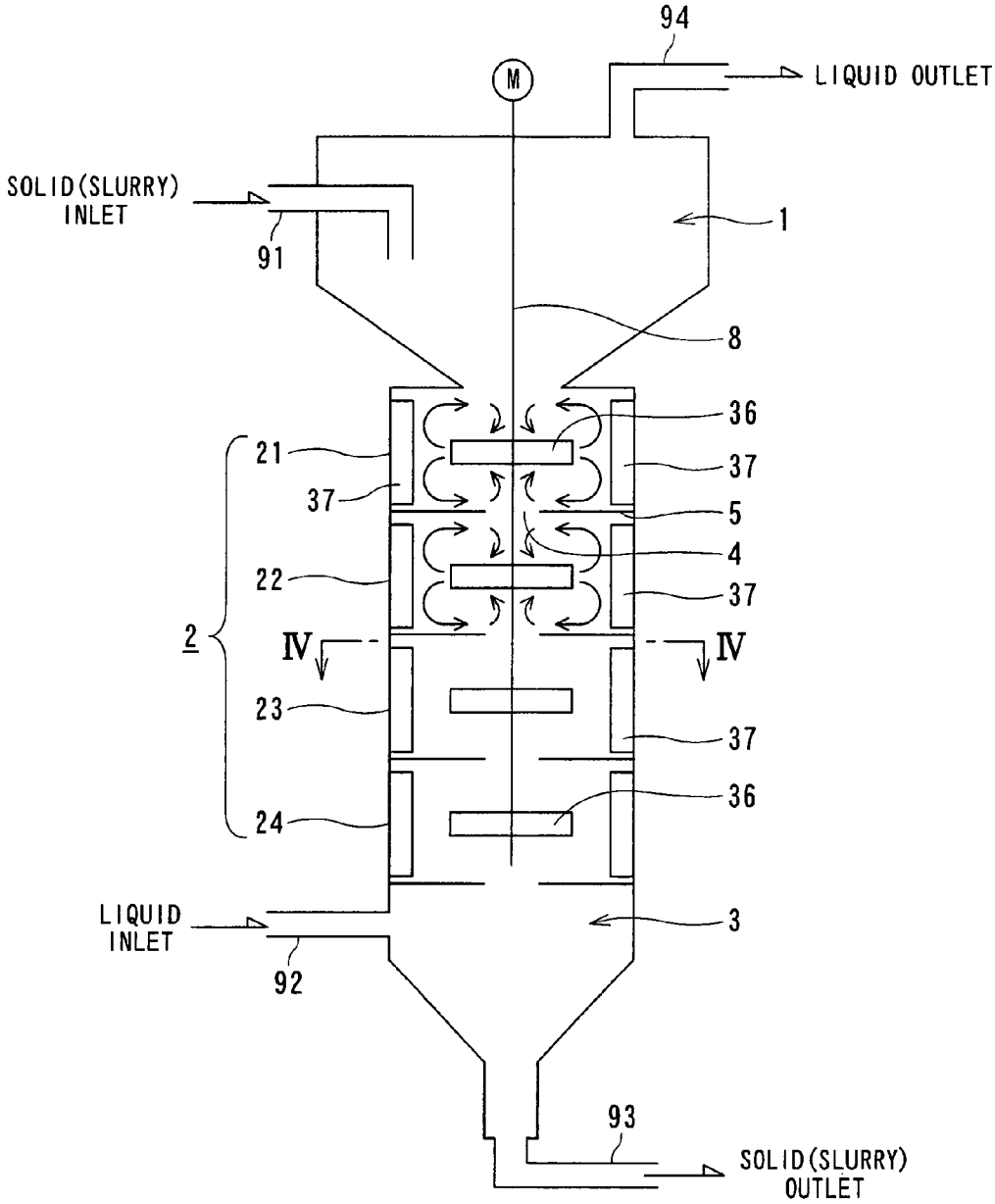
FIG. 3 is a schematic vertical sectional view of a conventional solid-liquid contact apparatus.
Figure 4:
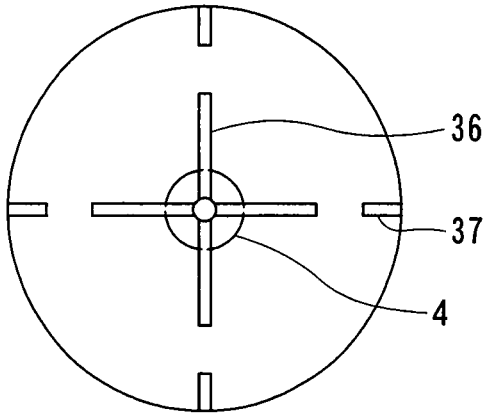
FIG. 4 is a sectional view as viewed in the direction of arrows IV-IV in FIG. 3.

For example, FIG. 3 is a schematic vertical sectional view of such a conventional-type apparatus, and FIG. 4 is a sectional view as viewed in the direction of arrows IV-IV. The apparatus of FIGS. 3 and 4 is different from the apparatus of FIGS. 1 and 2 only in that in each stirring chamber 21-24, a stirring blade 36 is at an almost central position and baffles 37 are disposed over an almost entire height of the chamber. In such an apparatus, no rectifying region is formed in proximity to the ceiling of each stirring chamber, and corresponding thereto, back mixing is caused due to obstruction of formation of a descending flow and an ascending flow at a central hole of a partitioning plate between adjacent stirring chambers, so that the essential effects of the apparatus of the present invention are lost.

Examples of Modification

In the above, a preferred embodiment of the vertical countercurrent solid-liquid contact apparatus according to the present invention has been described while referring to FIGS. 1 and 2. However, it is believed easily understandable for one of ordinary skilled in the art that the apparatus of FIGS. 1 and 2 can be modified in various manners within the scope of the present invention.

For example, the number of stirring chambers constituting the apparatus is not restricted to 4 as shown but be varied in a range of, e.g., 2-400, depending on a required theoretical number of solid-liquid contact stages (or plates). Further, the apparatus can be modified into a series of plural vertical solid-liquid contact apparatus by introducing the solid (slurry) from the pipe 93 into a pipe 91 of another solid-liquid contact apparatus of a similar structure as shown in FIG. 1 for further treatment therein.

Further, the stirring blade is not restricted to a flat paddle blade as shown but can have any blade shape, such as that of a disk turbine blade, as far as it can cause a radially ejected stream. Further, the number of baffles in one stirring chamber is not restricted to 4 in the above embodiment but can generally range from 1 to 12, while 2-8 is preferred. The baffles may ordinarily be disposed vertically on the inner wall of the stirring chamber.

In the continuous multi-stage stirring chamber-type solid-liquid contact apparatus of the present invention, it is a characteristic that a solid stream and a liquid stream go back and forth regularly as countercurrent streams (a descending flow and an ascending flow) through an opening (or aperture) of a partitioning plate disposed between adjacent stirring chambers. In the embodiment of FIG. 1, the countercurrent streams are formed at a periphery and a central part of a single aperture formed at a center of the partitioning plate, but the aperture is not restricted to a single one but can be disposed in a plurality. For example in the apparatus of FIG. 1, in addition to a central hole for passing an ascending stream, an aperture for principally passing a descending stream can be formed as a plurality of apertures or a single annular aperture shifted toward the inner wall.

Further, the apparatus of FIG. 1 is designed as a solid-liquid contact apparatus for treating a solid and a liquid of which the solid has a larger density, but the same apparatus can also be used, for solid-liquid contact between a liquid and a solid (e.g., hollow foam particles) having a smaller density than the liquid by introducing the solid (slurry) from the pipe 92 and the liquid from the pipe 91. In this instance, the pipe 94 functions as the outlet for the solid (slurry) and the pipe 93 functions as the outlet for the heavier liquid, as a natural consequence. In this modification, it may also be desirable to change relative sizes of the top section 1 and the bottom section 3 with respect to the main body section 2 in many cases, for example.

(Utilization of the Apparatus of the Invention)

The continuous multi-stage stirring chamber-type countercurrent solid-liquid contact apparatus of the present invention can be widely used, e.g., for extraction into a liquid of a valuable component in a solid, such as tea, coffee, sugar, perfume, oil or fat, and a minor quantity natural component; washing with water of dressed meat or fish meat; recovery of solvents for polymerization of synthetic resins, and washing of resin particles or formed pellets; washing of unnecessary components in a washed solid such as a recycled plastic; a reaction between a solid and liquid, and a reaction such as polymerization between a liquid and a liquid to form a solid product; impregnation of a solid with a liquid component and rinsing of solid surface; and dissolution of a solid in a liquid, and peptization of colloidal precipitate.

As a preferable example of utilization, the solid-liquid contact apparatus of the present invention can be used for washing of PAS (polyarylene sulfide) resin particles for the purpose of polymerization solvent from a PAS polymerizate slurry or purification of the resin particles subsequent thereto.

More specifically, a process for treating a polymerizate slurry containing PAS slurry particles obtained by a polymerization step is described in JP-A 61-255933. The treatment process includes (1) a step of separating a polymerizate slurry containing polyarylene sulfide particles, by-produced crystalline and dissolved alkali chloride, arylene sulfide oligomer and N-methylpyrrolidone as a principal liquid component by sieving into polyarylene sulfide particles and a slurry containing the crystalline alkali chloride, (2) a step of subjecting the slurry containing the crystalline alkali chloride to solid-liquid separation to recover the crystalline alkali chloride, and distilling the liquid component to recover N-methylpyrrolidone, (3) a step of washing the polyarylene sulfide particles with an organic solvent, such as acetone, and water; and (4) a step of distilling the organic solvent washing liquid to recovered solvent. The solid-liquid contact apparatus of the present invention can also be used as a continuous washing apparatus suitably applicable to the above-mentioned step (3).

EXAMPLES

Hereinbelow, the present invention will be described more specifically based on Examples and Comparative Examples.

Example 1

In a solid-liquid contact apparatus having an organization shown in FIG. 1 (and FIG. 2), a PPS (polyphenylene sulfide) slurry was supplied at a rate of 25 kg/h through a pipe 91 and water was supplied as a washing liquid at a rate of 37.5 kg/h from the pipe 92 to effect a continuous solid-liquid contact treatment. The treatment flow rate or load of the apparatus was 62.5 kg/h as a total of the slurry and water supply rates. The PPS slurry contained 5 kg/h of PPS particles (on a dry basis), 16 kg/h of water and 4 kg/h of acetone, so that the liquid excluding the PPS particles in the slurry contained 20 wt. % of acetone (acetone concentration in the slurry of 16 wt. %) and the concentration of the PPS particles in the slurry was 20 wt %. Further, a washing bath ratio L/P determined as a ratio of the washing liquid to the PPS particles in the slurry was 7.5 (=37.5/(25×0.2).

The apparatus had 4 stirring chambers 21-24 which were made of an acrylic resin sheet and allowed seeing-through of the inside thereof. Each stirring chamber had an inner diameter D=104 mm, a height H=125 mm, a stirring shaft 8 having an outer diameter of 20 mm and a partitioning plate 5 with an aperture 4 having an inner diameter of 32 mm, thus providing an aperture ratio of the partitioning plate of 5.8%. Further, each stirring chamber was provided with 4 flat paddle blades which were in sizes providing a stirring blade diameter of 60 mm (i.e., d=0.06 m) as a total of two blades and a blade width of 20 mm (b=0.02 m). The 4 blades were fixed about the stirring shaft 8 at equi-angular spacings of 90° from each other so as to extend in a height range of 22 mm to 42 mm above the partitioning plate 5. Further, 4 baffles 7 each measuring a lateral width of 15 mm and a height of 60 mm were fixed at 4 points of the inner wall with equi-angular spacings of 90° from each other so as to extend in a height range of 0 mm to 63 mm above the partitioning plate 5.

In the above apparatus, the stirring shaft 8 was rotated at a speed of 200 rpm (i.e., n=200/60=10/3 (1/s), corresponding to an average stirring Reynolds number in the stirring chamber $Re=6.4\times10^3$ as shown in a calculation described later). In this stirring state, as mentioned above, the PPS slurry was supplied from the pipe 91 at 25 kg/h, and water was supplied from the pipe 92 at 37.5 kg/h. As a result, owing to the functions of the flat paddle blades 6 and the baffles 7 disposed only in a lower half of each stirring chamber, there was observed a fluid dynamic state characterized by a relatively small circulating flow below the blades 6, a relatively large circulating flow above the blades 6, a descending flow at the outer periphery of the aperture 4, an ascending flow at the center of the aperture 4 (respectively represented by arrows in FIG. 1, for example) and a gentle flow state (with no arrows) at an upper part of the stirring chamber. Further, the waste liquid was discharged from the pipe 94 at 37.5 kg/h, and the washed slurry was discharged from the bottom pipe 93 at 25 kg/h so as to retain a particle concentration of 20 wt. % in the slurry. As a result, the acetone concentration in the discharged slurry (acetone concentration at the outlet) was 0.22 wt. %.

Incidentally, in the above apparatus, the slurry supply rate to the pipe 91 and water supply rate to the pipe 92 were gradually increased, while retaining the washing bath ratio L/P=7.5, up to a treatment load (as a total of the slurry and water supply rates) of 66 kg/h (5.3 kg/h as PPS particles), when the slurry discharge rate from the pipe 93 was not increased any more but stagnation of solid in the stirring chambers was observed in response to a further increase of the supply rates, so that 66 kg/h was taken as the maximum treatment load.

Accordingly, the above-mentioned treatment load of 62.5 kg/h (5 kg/h as PPS particles) corresponds to 95% of the maximum treatment load.

The above-mentioned average stirring Reynolds number in the stirring chamber Re was calculated in the following manner.

As described hereinbefore, Re can be calculated according to the following formula (1) (Reference books: "Kagaku Kogaku Binran (6th. Ed.)", "Kagaku Binran (4th. Ed.)")

$$Re=\rho n d^2/\mu \quad (1)$$

wherein ρ: average density of a slurry liquid in a stirring chamber [kg/m$^3$], n: stirring rotation speed [1/s], d: stirring blade diameter [m], and μ: viscosity of the slurry liquid in the stirring chamber [Pa·s]. Then, ρ and μ can be obtained in the following manner.

(i) Average Density ρ [kg/m3] of Slurry Liquid

ρ can be obtained from formula (2) below:

$$\rho=\Phi\cdot\rho s+(1-\Phi)\cdot\rho 1 \quad (2),$$

wherein ρ1: liquid density [kg/m3], ρs: apparent density of solid [kg/m3], Φ: volumetric ratio of solid [−].

ρ1 can be obtained by accurately measuring the volume and the mass of a liquid and dividing the mass with the volume, but the data of pure substances or mixtures thereof may also be available from handbooks, etc. For obtaining ρs, the true density ρst of a solid is measured by using a pycnometer. Then, the solid is immersed in a slurry-forming liquid and then pulled out of the liquid, immediately followed by measurement of the wet mass Ww [kg] thereof. Then, the liquid is removed, and the solid after drying is weighed to obtain a dry mass Wd [kg]. ρs is calculated according to formula (3) below:

$$\rho s=\rho 1\times((Ww-Wd)/Ww)+\rho st\times(1-(Ww-Wd)/Ww) \quad (3).$$

The values of ρs and ρ1 vary locally, particularly along the axis, so that these values are calculated for the uppermost stirring chamber and the lowermost stirring chamber (i.e., the 1$^{st}$ and 4$^{th}$ stages in this case), and an arithmetic mean thereof is obtained.

Φ (volumetric content of solid) may for example be obtained by once stopping an operation of the apparatus in a constant operation state thereof, discharging the whole slurry from the apparatus, immediately pulling out the solid from the slurry and weighing wet mass Ww of the solid to calculate Φ according to formula (4) below wherein V1 denotes an inner volume of the apparatus:

$$\Phi=(Ww/\rho s)/V1 \quad (4).$$

These parameters were calculated, e.g., for Example 1 as follows.

First, values of ρs are obtained for the 1$^{st}$ and 4$^{th}$ stages from formula (3) above. From "Kagaku Binran (4$^{th}$ Ed.)", densities at 20° C. were 998 kg/m$^3$ (ρw) for water and 791 kg/m$^3$ for acetone. As measured data by gas chromatography, the acetone concentration was 4.5 wt. % (Cac1) and 0.43 wt. % (Cac2) for the 1$^{st}$ and 4$^{th}$ stages, respectively. Accordingly, the water concentration was 95.5 wt. % (Cw1) and 99.57 wt. % (Cw2) for the 1$^{st}$ and 4$^{th}$ stages. From these, ρ1 (density of liquid) was calculated as follows.

First, the acetone concentration values for the respective stages were converted from wt. % values (Cac1, Cac2) to vol. % values (Fac1, Fac2) as follows: 1$^{st}$ stage:

$$Fac1 = 100*(Cac1/\rho ac)/(Cac1/\rho ac + Cw1/\rho w)$$
$$= (100)(4.5/791)/(4.5/791 + 95.5/998) = 5.61.$$

4$^{th}$ Stage:

$$Fac2 = 100*(Cac2/\rho ac)/(Cac2/\rho ac + Cw2/\rho w)$$
$$= (100)(0.43/791)/(0.43/791 + 99.57/998) = 0.54.$$

Accordingly, the 1$^{st}$ stage liquid density was:

$$\rho 11 = (Fac1/100)*\rho ac + ((100 - Fac1)/100*\rho w$$
$$= (0.0561)(791) + (1 - 0.0561)(998) = 986\ \text{kg/m}^3.$$

The 4$^{th}$ stage liquid density was:

$$P12 = (Fac2/100)*\rho ac + ((100 - Fac2)/100*\rho w.$$
$$= (0.0054)(792) + (1 - 0.0054)(998) = 997\ \text{kg/m}^3.$$

From the above, an average density of liquid in the apparatus was obtained as:

$$\rho 1=(986+997)/2=992\ \text{kg/m}^3.$$

Next, as measured values, Ww=1 kg, Wd=0.5 kg and ρsr=1300 kg, which were substituted in formula (3) above to calculate ρs1 and ρs2 in the 1$^{st}$ and 4$^{th}$ stages as follows:

$$\rho s1=(986)(0.5)+(1300)(0.5)=1143\ \text{kg/m}^3$$

$$\rho s2=(997)(0.5)+(1300)(0.5)=1149\ \text{kg/m}^3.$$

From the above, an average density (ρs) of the solid in the apparatus was obtained as:

$$\rho s=(1143+1149)/2=1146\ \text{kg/m}^3.$$

Next, Φ was obtained from formula (4) above as follows:

Apparatus inner volume $V1$=(number of chambers)*(chamber inner diameter)$^2$*(3.14/4)*(chamber height)=(4)(0.104)$^2$*(0.785)(0.125)=0.00425 m$^3$.

Ww was measured at 1 kg, and as ρs was calculated at 1146 kg/m$^3$, Φ in formula (4) was calculated as:

$$\Phi=(1/1146)/(0.00425)=0.2.$$

From the above average values of liquid density (ρ1) and solid density (ρs), an average of the slurry density ρ was calculated as follows:

$$\rho=(0.2)(1146)+(1-0.2)(992)=1022\ \mathrm{kg/m^3}.$$

(ii) Average Viscosity μ[Pa·s]

$$\mu=\mu 1[1-(\Phi/0.62)]^{(-1.55)},$$

wherein μ1: (liquid viscosity) can be measured by various viscometers, but viscosity data for pure substances or mixtures thereof may be available from some handbooks.

In the case of Example 1, "Kagaku Binran (4th. Ed.)" gives viscosity data at 20° C. of $1.0\times10^{-3}$ Pa·s for water and $0.4\times10^{-3}$ Pa·s for acetone. Accordingly, for the 1st. stage, $$\mu 11=(0.0561)(0.4\times10^{-3})+(1-0.0561)(10^{-3})=0.966\times10^{-3}$$

$$\mu 1=0.966\times10^{-3}[(1-0.2/0.62)]^{(-1.55)}=1.8\times10^{-3}$$

For the 4th. stage, $$\mu 12=(0.0054)(0.4\times10^{-3})+(1-0.0054)(10^{-3})=1.0\times10^{-3}$$

$$\mu 2=1.0\times10^{-3}[(1-0.2/0.62)]^{(-1.55)}=1.8\times10^{-3}$$

Accordingly, the average viscosity in the stirring chambers can be calculated as follows:

$$\mu=(\mu 1+\mu 2)/2=1.8\times10^{-3}\ \mathrm{Pa\cdot s}$$

As a result, the stirring Reynolds number Re in Example 1 is calculated as follows:

$$Re=\rho n d^2/\mu=1022\times(10/3)\times(0.06)^2/(1.8\times10^{-3})=6.8\times10^3.$$

The outline of the apparatus operation conditions and operation results are inclusively shown in Table 1 appearing hereinafter together with those of the following Examples.

Reference Example 1

While the stirring conditions and the washing bath ratio (L/P=7.5) of Example 1 were retained, the treatment load (as a total of the slurry supply rate to the pipe 91 and the water supply rate to the pipe 92) was reduced down to 37.5 kg/h (3 kg/h as PPS particles). As a result, the outlet acetone concentration was 0.60 wt. % and the average stirring Reynolds number Re in the apparatus was $6.82\times10^3$. The treatment load of 37.5 kg/h corresponds to 57% of the maximum load.

Reference Example 2

In Reference Example 1, the blade rotation speed was reduced down to 4 rpm, which corresponded to an average stirring Reynolds number Re in the apparatus of $1.37\times10^2$. Under the stirring condition and while retaining the washing bath ratio (L/P=7.5), the treatment load (as a total of the slurry supply rate to the pipe 91 and the water supply rate to the pipe 92) was set at 37.5 kg/h (3 kg/h as the PPS particles). As a result, the outlet acetone concentration was 1.40 wt. %.

Incidentally, in the above apparatus, the slurry supply rate to the pipe 91 and water supply rate to the pipe 92 were gradually increased, while retaining the washing bath ratio L/P=7.5, up to a treatment load (as a total of the slurry and water supply rates) of 40 kg/h, when the slurry discharge rate from the pipe 93 was not increased any more but stagnation of solid in the stirring chambers was observed in response to a further increase of the supply rates, so that 40 kg/h was taken as the maximum treatment load. Accordingly, the above-mentioned treatment load of 37.5 kg/h (3 kg/h as PPS particles) corresponds to 95% of the maximum treatment load.

Reference Example 3

The apparatus of Reference Example 2 was modified to provide the partitioning plates 5 with an aperture 4 having an increased diameter of 52 mm and an aperture ratio of 21%, whereby the maximum treatment load was increased to 66 kg/h (5.3 kg/h as PPS particles). The average stirring Reynolds number Re in the apparatus at that time was $1.38\times10^2$. Then, while the washing bath ratio L/P=7.5 was retained, the treatment load was set to 62.5 kg/h (5 kg/h as PPS particles) corresponding to 95% of the maximum load, thereby effecting a solid-liquid contact treatment. As a result, the outlet acetone concentration was 3.60 wt. %.

Example 2

A solid-liquid contact operation was performed by using an apparatus having an organization shown in FIG. 1 which was similar to the one used in Example 1 and had an inner diameter D=104 mm, a stirring chamber height H=63 mm, an inner diameter of aperture 4 of 32 mm and an outer diameter (d) of the stirring shaft=20 mm, thus giving a partitioning plate aperture ratio of 5.8%. The aperture ratio and the height were respectively a half of those in Example 1. Further, each stirring chamber was provided with 4 flat paddle blades 6 which were in sizes providing a blade diameter of 60 mm and a blade width of 20 mm, and fixed about the stirring shaft 8 at equi-angular spacings of 90° from each other so as to extend in a height range of 6 mm to 26 mm above the partitioning plate 5. Further, 4 baffles 7 each measuring a lateral width of 15 mm and a height of 32 mm were fixed at 4 points of the inner wall with equi-angular spacings of 90° from each other so as to extend in a height range of 0 mm to 32 mm above the partitioning plate 5.

In the above apparatus, the stirring shaft 8 was rotated at a speed of 200 rpm ($Re=6.8\times10^3$). In this stirring state, a PPS slurry identical to the one used in Example 1 was supplied from the pipe 91 at 14 kg/h, and water was supplied from the pipe 92 at 21 kg/h, thereby effecting a solid-liquid contact treatment at a total treatment load of 35 kg/h (2.8 kg/h as PPS particles). As a result, the acetone concentration in the discharged slurry (outlet acetone concentration) was 0.32 wt. %.

Incidentally, in the apparatus, the slurry supply rate to the pipe 91 and water supply rate to the pipe 92 were gradually increased, while retaining the washing bath ratio L/P=7.5, up to a treatment load (as a total of the slurry and water supply rates) of 37 kg/h, when the slurry discharge rate from the pipe 93 was not increased any more but stagnation of solid in the stirring chambers was observed in response to a further increase of the supply rates, so that 37 kg/h was taken as the maximum treatment load. Accordingly, the above-mentioned treatment load of 35 kg/h (2.8 kg/h as PPS particles) corresponds to 95% of the maximum treatment load.

Reference Example 4

While the stirring conditions and the washing bath ratio (L/P=7.5) of Example 2 were retained, the treatment load (as a total of the slurry supply rate to the pipe 91 and the water supply rate to the pipe 92) was reduced down to 26.3 kg/h (2.1 kg/h as PPS particles). As a result, the outlet acetone concentration was 0.47 wt. % and the average stirring Reynolds number Re in the apparatus was $6.8\times10^3$. The treatment load of 26.3 kg/h corresponds to 72% of the maximum load.

Comparative Example 1

A solid-liquid contact operation similar to the one in Example 1 was performed by using an apparatus shown in FIG. 3 instead of FIG. 1.

In the apparatus of FIG. 3, each stirring chamber 21-24 was provided with flat paddle blades 36, which were substantially identical to the stirring blades 6 in FIG. 1 but were disposed at a center of each stirring chamber, and baffles 37 each having a lateral width of 15 mm and a height of 125 mm, instead of the baffles 7, were disposed to extend over the entire height of each stirring chamber. The other organization was substantially similar to that of FIG. 1.

In the apparatus, the same PPS particle slurry as in Example 1 and water were supplied at a washing bath ratio L/P=7.5, and the stirring blade 37 were rotated at the same speed as in Example 1 of 200 rpm (Re=$6.8\times10^3$). As a result, there occurred identical sizes of circulating flows above and below the stirring blades in each stirring chamber as represented by arrows in the stirring chamber 21 in FIG. 3 so that the circulating flows in mutually adjacent stirring chambers obstructed each other in proximity to the center aperture 4, and the formation of a descending flow or an ascending flow through the center aperture was not observed.

When the washing bath ratio L/P=7.5 was retained similarly as in Example 1, the maximum treatment load was judged to be around 79 kg/h (6.3 kg/h as PPS particles), and when a solid-liquid contact operation was performed at a treatment load of 75 kg/h (6 kg/h as PPS particles) corresponding to 95% of the maximum, the outlet acetone concentration was 0.62 wt. %.

Comparative Example 2

The apparatus of Comparative Example 1 was modified so that the 4 baffles were each changed in sizes of lateral width of 15 mm and a reduced height of 63 mm and fixed so as to extend in a height level of 0 mm to 63 mm above the partitioning plate 5, while retaining the other organization. When the stirring blades were rotated at a speed of 200 rpm similarly as in Comparative Example 1, the average stirring Reynolds number Re in the apparatus was $6.8\times10^3$.

The maximum treatment load was reduced to 60 kg/h (5.3 kg/h as PPS particles). A solid-liquid contact operation was performed at a treating load of 62.5 kg/h (5 kg/h as PPS particles) corresponding to 95% of the maximum load while retaining the washing bath ratio L/P=7.5, whereby the outlet acetone concentration was 0.57 wt. %.

Comparative Example 3

The apparatus of Comparative Example 1 was modified so that the stirring blades 36 were reduced in height to 32 mm and fixed to the stirring shaft over a height range of 22 mm to 42 mm above the partitioning plate 5 similarly as the blades 6 in FIG. 1, while retaining the other organization. When the stirring blades were rotated at a speed of 200 rpm similarly as in Comparative Example 1, the average stirring Reynolds number Re in the apparatus was $6.8\times10^3$.

The maximum treatment load was judged to be around 79 kg/h (6.3 kg/h as PPS particles). A solid-liquid contact operation was performed at a treating load of 75 kg/h (6 kg/h as PPS particles) corresponding to 95% of the maximum load while retaining the washing bath ratio L/P=7.5, whereby the outlet acetone concentration was 0.56 wt. %.

Example 3

A solid-liquid contact operation was performed by using an apparatus having an organization shown in FIG. 1 which was similar to the one used in Example but scaled up to an inner diameter D=311 mm, a stirring chamber height H=156 mm, an inner diameter of aperture 4 of 72 mm and an outer diameter (d) of the stirring shaft 8=20 mm, thus giving a partitioning plate aperture ratio of 5.4%. Further, each stirring chamber was provided with 4 flat paddle blades 6 which were in sizes providing a blade diameter of 150 mm and a blade width of 30 mm, and fixed about the stirring shaft 8 at equi-angular spacings of 90° from each other so as to extend in a height range of 24 mm to 54 mm above the partitioning plate 5. Further, 4 baffles 7 each measuring a lateral width of 42 mm and a height of 78 mm were fixed at 4 points of the inner wall with equi-angular spacings of 90° from each other so as to extend in a height range of 0 mm to 78 mm above the partitioning plate 5.

In the above apparatus, the stirring shaft 8 was rotated at a speed of 50 rpm and the average stirring Reynolds number Re in the apparatus at this time was $1.1\times10^4$. In this stirring state, a PPS slurry identical to the one used in Example 1 was supplied from the pipe 91 at 250 kg/h, and water was supplied from the pipe 92 at 375 kg/h, thereby effecting a solid-liquid contact treatment at a total treatment load of 625 kg/h (50 kg/h as PPS particles). As a result, the acetone concentration in the discharged slurry (outlet acetone concentration) was 0.16 wt. %.

Incidentally, in the apparatus, the slurry supply rate to the pipe 91 and water supply rate to the pipe 92 were gradually increased, while retaining the washing bath ratio L/P=7.5, up to a treatment load (as a total of the slurry and water supply rates) of 658 kg/h, when the slurry discharge rate from the pipe 93 was not increased any more but stagnation of solid in the stirring chambers was observed in response to a further increase of the supply rates, so that 658 kg/h was taken as the maximum treatment load. Accordingly, the above-mentioned treatment load of 625 kg/h (50/h as PPS particles) corresponds to 95% of the maximum treatment load.

Example 4

The apparatus of Example 3 was operated by reducing the stirring blade rotation speed down to 30 rpm corresponding to an average stirring Reynolds number Re in the apparatus of $6.4\times10^3$. In this stirring state, a solid-liquid contact operation was performed in a similar manner as in Example 3, whereby the outlet acetone concentration was 0.32 wt. %. The maximum treatment load in this operation was judged to be 658 kg/h (52.6 kg/h as PPS particles).

The outlines of the apparatus, operation conditions and operation results of the above Examples, Reference Examples and Comparative Examples are inclusively shown in the following Table 1.

TABLE 1

| Example | Height from the partitioning plate: Blade center | Height from the partitioning plate: Baffle upper edge | D (m) | d (m) | b (m) | H (m) | Aperture ratio (%) | Rotation speed (RPM) | Re (×103) | Treatment Load (kg/h) | Maximum load (kg/h) | Load ratio (%) | Outlet acetone concentration (wt. %) |
|---|---|---|---|---|---|---|---|---|---|---|---|---|---|
| 1 | 0.032 | 0.063 | 0.104 | 0.06 | 0.02 | 0.125 | 5.8 | 200 | 6.8 | 62.5 | 66 | 95 | 0.22 |
| Ref. 1 | 0.032 | 0.063 | 0.104 | 0.06 | 0.02 | 0.125 | 5.8 | 200 | 6.8 | 37.5 | 66 | 57 | 0.60 |
| Ref. 2 | 0.032 | 0.063 | 0.104 | 0.06 | 0.02 | 0.125 | 5.8 | 4 | 0.14 | 37.5 | 40 | 95 | 1.40 |
| Ref. 3 | 0.032 | 0.063 | 0.104 | 0.06 | 0.02 | 0.125 | 21 | 4 | 0.14 | 62.5 | 66 | 95 | 3.60 |
| 2 | 0.016 | 0.032 | 0.104 | 0.06 | 0.02 | 0.063 | 5.8 | 200 | 6.8 | 35 | 37 | 95 | 0.32 |
| Ref. 4 | 0.016 | 0.032 | 0.104 | 0.06 | 0.02 | 0.063 | 5.8 | 200 | 6.8 | 26.25 | 36 | 72 | 0.47 |
| Comp. 1 | 0.063 | 0.125 | 0.104 | 0.06 | 0.02 | 0.125 | 5.8 | 200 | 6.8 | 75 | 79 | 95 | 0.62 |
| Comp. 2 | 0.063 | 0.063 | 0.104 | 0.06 | 0.02 | 0.125 | 5.8 | 200 | 6.8 | 62.5 | 66 | 95 | 0.57 |
| Comp. 3 | 0.032 | 0.125 | 0.104 | 0.06 | 0.02 | 0.125 | 5.8 | 200 | 6.8 | 75 | 79 | 95 | 0.56 |
| 3 | 0.039 | 0.078 | 0.311 | 0.15 | 0.03 | 0.156 | 5.4 | 50 | 11 | 625 | 658 | 95 | 0.16 |
| 4 | 0.039 | 0.078 | 0.311 | 0.15 | 0.03 | 0.156 | 5.4 | 30 | 6.4 | 625 | 658 | 95 | 0.32 |

D: inner diameter of stirring chamber (m), d: stirring blade diameter (m), b: blade width (m), H: stirring chamber height (m), Re: stirring Reynolds number (–)

As shown in Table 1, Example 1 exhibited a high treatment capacity (load) and also a high solid-liquid contact efficiency (i.e., a low outlet acetone concentration and a high stage efficiency). Reference Example 1 shows that a lower load ratio rather resulted in a lower solid-liquid contact efficiency. Reference Example 2 resulted in a low treatment capacity and a low solid-liquid contact efficiency because of a low Re. Reference Example 3 resulted in an increased treatment capacity due to an increased aperture ratio but resulted in a further low solid-liquid contact efficiency. In any of Comparative Example 1 using an apparatus of FIG. 3, Comparative Example 2 satisfying only the baffle position requirement of the present invention and Comparative Example 3 satisfying only the stirring blade position of the present invention, only lower solid-liquid contact efficiencies were obtained. Example 2 using a simply reduced stirring chamber height resulted in a fairly good solid-liquid contact efficiency. Examples 3 and 4 resulted in good solid-liquid contact efficiencies at increased treatment load levels attained by scaling-up.

INDUSTRIAL APPLICABILITY

As described above, the present invention provides a (countercurrent) solid-liquid contact apparatus of the continuous multi-stage stirring chamber type which exhibits a good uniformity of solid-liquid flows and a high contact efficiency, is also simple in structure and allows easy scale-up, and also an effective solid-liquid contact method using the apparatus. The apparatus can be widely applied to unit operations principally in the chemical industry, such as washing, purification, extraction, impregnation, reaction and dissolution.

The invention claimed is:

1. A vertical solid-liquid contact apparatus for performing a solid-liquid contact operation, the vertical solid-liquid contact apparatus comprising:

a plurality of stirring chambers disposed vertically adjacent to one another in series, such that each stirring chamber of the plurality of stirring chambers is adjacent to another stirring chamber of the plurality of stirring chambers;

a plurality of partitioning plates, each partitioning plate of the plurality of partitioning plates partitioning a respective adjacent pair of stirring chambers of the plurality of stirring chambers and each partitioning plate of the plurality of partitioning plates including a communicating hole for communication between the respective adjacent pair of stirring chambers;

a liquid inlet provided at a lower part of the vertical solid-liquid contact apparatus for continuously introducing a liquid into the lower part of the solid-liquid contact apparatus, and being below the plurality of partitioning plates;

a solid inlet provided at an upper part of the vertical solid-liquid contact apparatus for continuously introducing a solid into the upper part of the solid-liquid contact apparatus, and being above the plurality of partitioning plates;

a solid outlet provided at a lower part of the solid-liquid contact apparatus for continuously discharging a solid out of the lower part of the solid-liquid contact apparatus, and being below the plurality of partitioning plates; and a liquid outlet provided at an upper part of the vertical solid-liquid contact apparatus, wherein each stirring chamber of the plurality of stirring chambers includes (i) an inner side wall that defines the stirring chamber, (ii) a radially ejecting stirring blade, and (iii) a baffle fixed to the inner side wall and extending vertically along the inner side wall, wherein the stirring blade and the baffle of each respective stirring chamber of the plurality of stirring chambers are positionally biased to a lower side of the respective stirring chamber, wherein the liquid inlet is disposed below the plurality of stirring chambers, wherein the solid inlet and the liquid outlet are disposed above the plurality of stirring chambers, wherein all of the liquid inlet, the solid inlet, the solid outlet and the liquid outlet are separate from each other, and wherein the diameter of each radially ejecting stirring blade is larger than the diameter of each communicating hole.

2. A vertical solid-liquid contact apparatus according to claim 1, wherein the stirring blade and the baffle of each respective stirring chamber are disposed in a generally lower half region of the respective stirring chamber.

3. A vertical solid-liquid contact apparatus according to claim 1, wherein the stirring blade of each respective stirring chamber is a flat paddle blade.

4. A vertical solid-liquid contact apparatus according to claim 1, wherein the stirring blade of each respective stirring chamber is a disk-turbine blade.

5. A vertical solid-liquid contact apparatus according to claim 1, wherein the stirring blades of the plurality of stirring chambers are provided with a common stirring shaft, and wherein the communication hole of each partitioning plate of the plurality of partitioning plates is formed around the common stirring shaft.

6. A vertical solid-liquid contact apparatus according to claim 1, wherein the solid inlet is a solid slurry inlet.

7. A vertical solid-liquid contact apparatus according to claim 1, wherein each stirring chamber of the plurality of stirring chambers has a height (H) and an inner diameter (D) providing a ratio (H/D) in a range of 0.1 to 3.0.

8. A vertical solid-liquid contact apparatus according to claim 1, wherein the communicating hole of each respective partitioning plate of the plurality of partitioning plates has an opening area that is 0.2% to 20% of a cross-sectional area of a stirring chamber of the plurality of stirring chambers at a position of the respective partitioning plate that partitions the stirring chamber from other stirring chambers of the plurality of stirring chambers.

* * * * *